United States Patent [19]

Rogers

[11] 4,401,048

[45] Aug. 30, 1983

[54] PORTABLE BOAT HULL SCRUBBER

[76] Inventor: Robert C. Rogers, 2836 Comanche Dr., Kettering, Ohio 45420

[21] Appl. No.: 359,189

[22] Filed: Mar. 17, 1982

[51] Int. Cl.[3] ..... B63B 59/00

[52] U.S. Cl. ..... 114/222

[58] Field of Search ..... 114/222; 15/DIG. 2; 51/8, 9, 180

[56] References Cited

U.S. PATENT DOCUMENTS 200,696 2/1878 Cole ..... 114/222

205,791 7/1878 Fielder ..... 114/222

FOREIGN PATENT DOCUMENTS 1580337 9/1969 France ..... 114/222

11547 10/1924 Netherlands ..... 114/222

*Primary Examiner*—Trygve M. Blix

*Assistant Examiner*—Jesús D. Sotelo

*Attorney, Agent, or Firm*—Louis E. Hay

[57] ABSTRACT

A portable boat hull scrubber for detachably mounting onto a boat and adapted to scrub the adhering debris from the underwater portion of the hull, said scrubber functioning with the boat stationary in the water.

6 Claims, 11 Drawing Figures

18
16
20
22
24
26
28
30
34
36
38
40
40a
42
42a
42b
42c
44
46
48
50
54
56
58
60
62
64
68
70
72
74
76
78
80
4
6

WATER LEVEL

WATER LEVEL

PORTABLE BOAT HULL SCRUBBER

REFERENCE TO RELATED U.S. PATENTS

No. 200,696 Apparatus For Cleaning Hulls of Vessels—Cole—issued Feb. 26, 1878.

No. 313,822 Device For Cleaning Ship Bottoms—Gustafson—issued Mar. 10, 1885.

No. 646,357 Machine For Cleaning Hulls of Vessels—Cook et al.—issued Mar. 27, 1900.

No. 659,779 Means For Scraping Hulls of Vessels—Wisdom—issued Oct. 16, 1900.

No. 721,347 Device For Cleaning The Bottom of Vessels—Willey—issued Feb. 24, 1903.

No. 2,327,012 Apparatus For Cleaning Ships' Bottoms—Bright—issued Aug. 17, 1943.

No. 3,088,429 Cleaning Devices For Removing Marine Growth From Ships' Hulls—Johannessen—issued May 7, 1963.

BACKGROUND OF THE INVENTION

The problem of removing marine growth and other debris from the underwater portion of the hulls on ships is as old as ships themselves. The composition of the debris will vary with the type and composition of the waters in which the ship or boat is used. Barnacles are a very severe problem on ships which navigate the oceans. Modern ocean going ships have steel hulls, and the barnacles are usually removed with jack hammer driven chisels after the ships are dry docked.

A review of the early referenced patents clearly indicates that attempts were being made to develop a method for removing the barnacles and other debris in a continuous manner while the ship was in operation. One of the problems during this era was that many ships did not have modern steel hulls, which made it desirable to remove the barnacles before they acquired maximum adherence to the hull. These early cleaners were water powered by turbine drives which were driven as they were moved through the water by the ships to which they were attached.

The referenced patents all issued before the private ownership of recreational boats, including cabin cruisers and yachts, reached its present popularity. The majority of these recreational boats are not operated in waters where they become infested with barnacles; however, they do accumulate other debris which should be periodically removed to properly preserve the boat and to prevent impairment of the boat's efficiency in the water.

At the present time, the boat must be either drydocked for cleaning by hand; or, it must be taken to a commercial facility which is similar in many respects to present day car-washes. The recreational boat must be navigated to the boat cleaning facility. In operation, the boat is positioned in the water to be above the submerged cleaning machine, which is then raised against the hull of the boat. There are a relatively few of these commercial cleaning facilities, and it is necessary for many boat owners to navigate their boat as much as 100 miles to have it cleaned. This is both expensive and also time consuming.

SUMMARY OF THE INVENTION

The present invention is primarily intended for use by owners of recreational boats. The present scrubber is designed to be detachably mounted on a large variety of such boats; however, if an owner so desires, after the scrubber is fitted to a particular boat, he can make a few minor changes, which will be described below, and which will save subsequent set-up time on that particular boat.

The principal components of the scrubber assembly consist of two support structures which are detachably fitted to the bow and stern of the boat, a scrubber cable passing longitudinally under the hull of the boat and supported at each end by one of the support structures, a scrubber unit having at least one rotating disc brush acting substantially normal to the area of the hull being scrubbed and driven by an electric motor within a buoyancy chamber, and either manual or power means for moving the scrubber unit fore and aft on the scrubber cable.

The support structures are further configured to permit shifting the lateral position of the scrubber cable on the hull. Thus, when one longitudinal portion of the hull has been scrubbed, the scrubber cable may be shifted in an amount which will permit scrubbing the next-adjacent section. This procedure is repeated until the entire hull has been scrubbed.

The referenced patents use either roller brushes, or metal scrapers which are not suitable for use on recreational boats which do not have metal hulls. In most cases the brushes or the cutters are rotated by rolling action when the scrubbers are manually pulled along the hull, or they are rotated by water turbines. In either design, the rotational speed is insufficient to be effective.

The present invention uses disc brushes which may be driven at higher speeds for efficiency and which, unlike most of the referenced art, have no direct correlation with the linear travel of the brushes on the hull. The disc brushes are also better suited for use against surfaces which are not plane. Since the mechanism driving the brushes is within a closed chamber, it cannot be fouled by debris in the water.

DESCRIPTION OF THE PREFERRED EMBODIMENT

Figure 1:
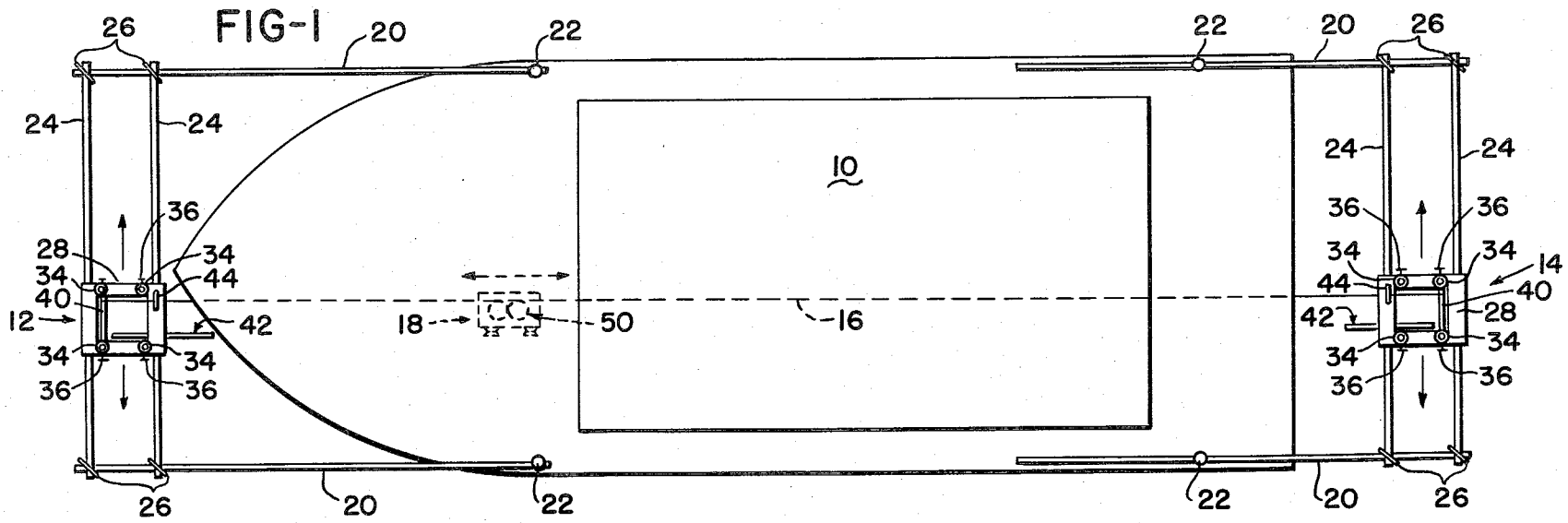
FIG. 1 is a plan view of the scrubber assembly mounted on a typical recreational boat having a short deck at the bow end.
Figure 2:
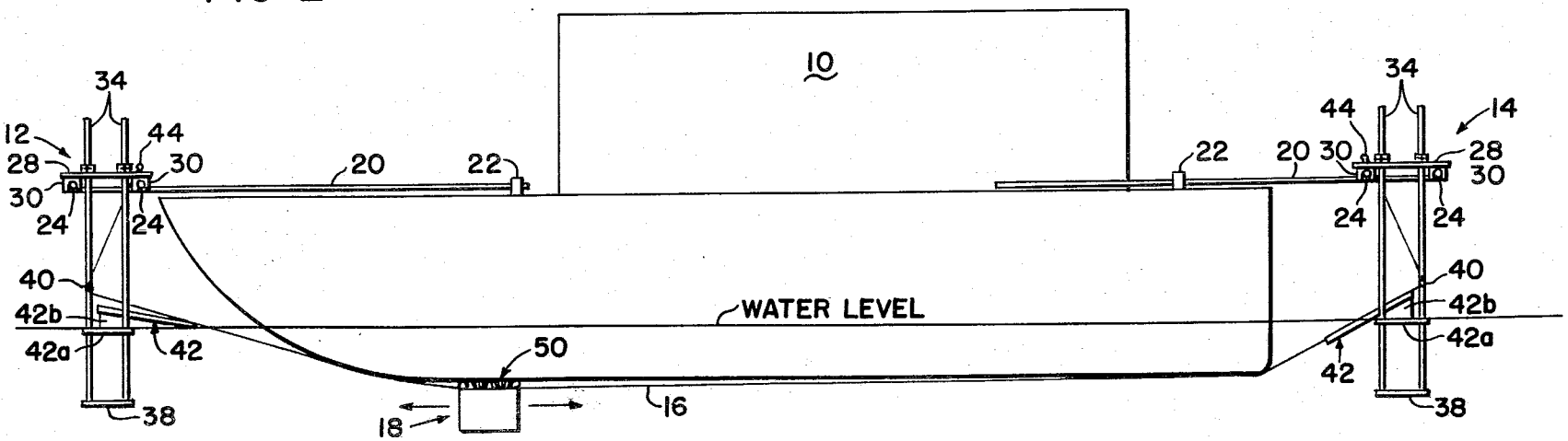
FIG. 2 is a side elevational of the scrubber assembly on the same boat.

As best depicted in FIGS. 1 and 2, detachably joined to boat 10 is a forward support structure 12 attached to the bow of the boat, and a rear support structure 14 attached to the stern of the boat. A scrubber cable 16 is longitudinally positioned below the hull of the boat, and is secured at both ends on the support structures 12 and 14. The scrubber unit 18 is functionally in engagement with the scrubber cable in a manner in which brushes on the scrubber unit 18 engage the hull of the boat. All components of the scrubber unit 18 will be described in greater detail below.

The forward and rear support structures 12 and 14 may use identical components, and may be interchanged except for a single difference in some cases which will be described below. The basic framework is formed of any suitable material such as light tubing, which will produce structures of minimum weight, and which is readily available. Each support structure has a pair of attaching tubes 20, one end of which is detachably held in place on the boat by means of support blocks 22 which may in many cases be existing cleats to which the tubes may be lashed. The other end of the tubes extend outwardly to clear the boat and to detachably support two spaced apart lateral tubes 24 which are held in place by U-clamps 26 which are most clearly depicted in FIG. 3.

The lateral tubes 24 provide a sliding support on which the carriage 28 may be manually moved as best shown in FIG. 1. The carriage has an attached U-shaped clip 30 at each corner, the downward extending sides of which straddle the tubes 24 as most clearly shown in FIG. 4. Each clip 30 is provided with a removable retaining pin 32 as also most clearly shown in FIG. 4. The retaining pins prevent the accidental detachment of the carriage from the lateral tubes. As most clearly shown in FIG. 3, the center portion of the carriage 28 is cut out to reduce weight.

The vertically adjustable portion of the support structures 12 and 14 includes four vertical tubes 34 which at the upper end are slidable through apertures in carriage 28 where they are retained in desired position by retaining screws 36. The lower ends of the vertical tubes 34 are welded or otherwise joined to a plate 38 which maintains the lower vertical alignment of the tubes and prevents their spread. The plate 38 may have the major center portion cut out to reduce weight.

Figures 4, 7, 9, 10:
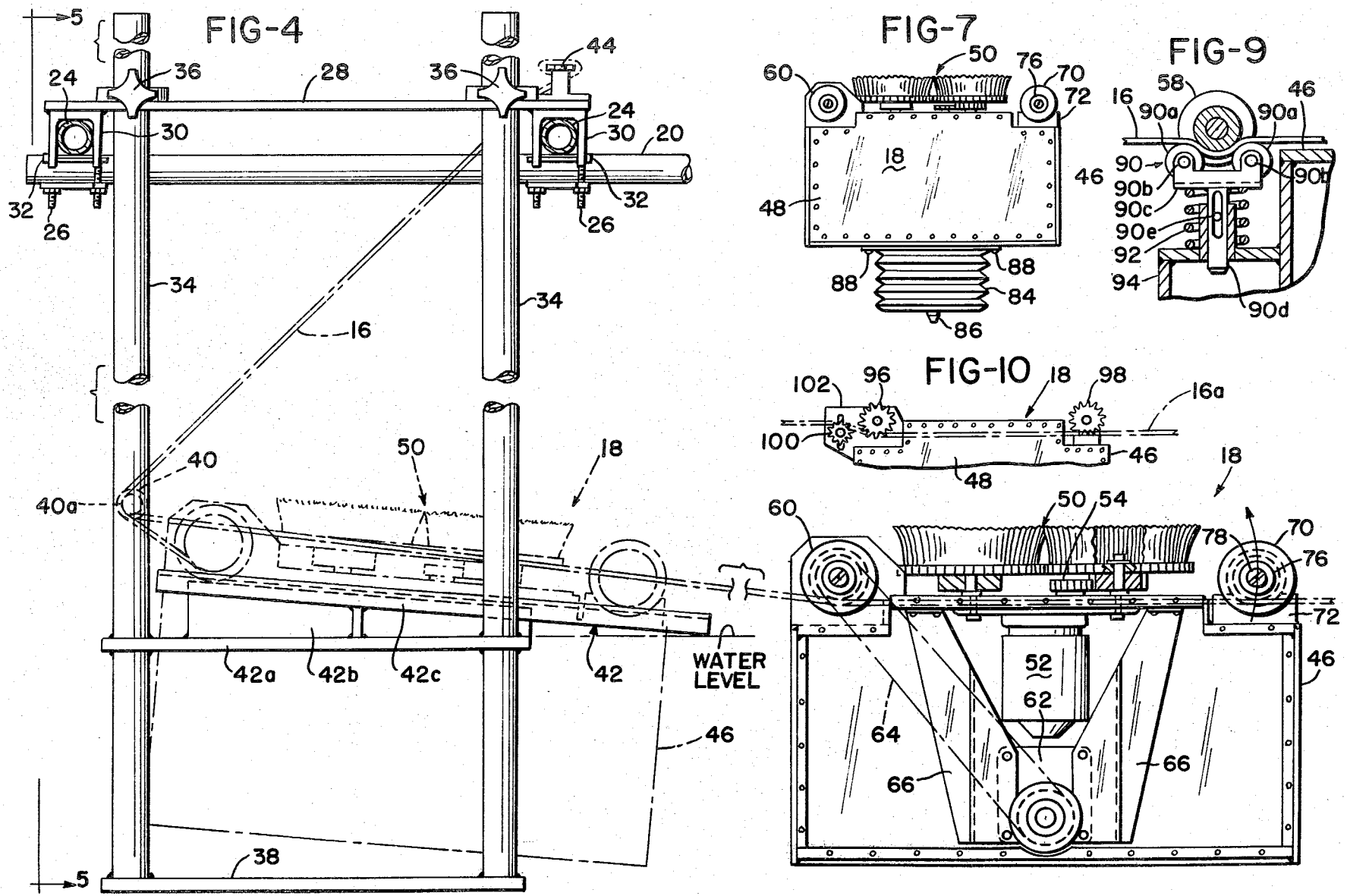
FIG. 4 is a side elevation taken along the line 4—4 of the support structure depicted in FIG. 3, and a side elevation of the scrubber unit with the near side cover removed to depict the internal construction.
FIG. 7 is a side elevation of the scrubber unit with an additional inflatable bouyancy chamber.
FIG. 9 is an elevation (partially in section) depicting an optional spring biased mechanism for applying pressure on the scrubber cable.
FIG. 10 is a fragmentary side elevation depicting the alternate use of a scrubber chain and sprockets; and, FIG. 11 is a reduced scale side elevation of the scrubber assembly on a boat, and having manual means for moving the scrubber unit.
Figures 5, 6, 8, 11:
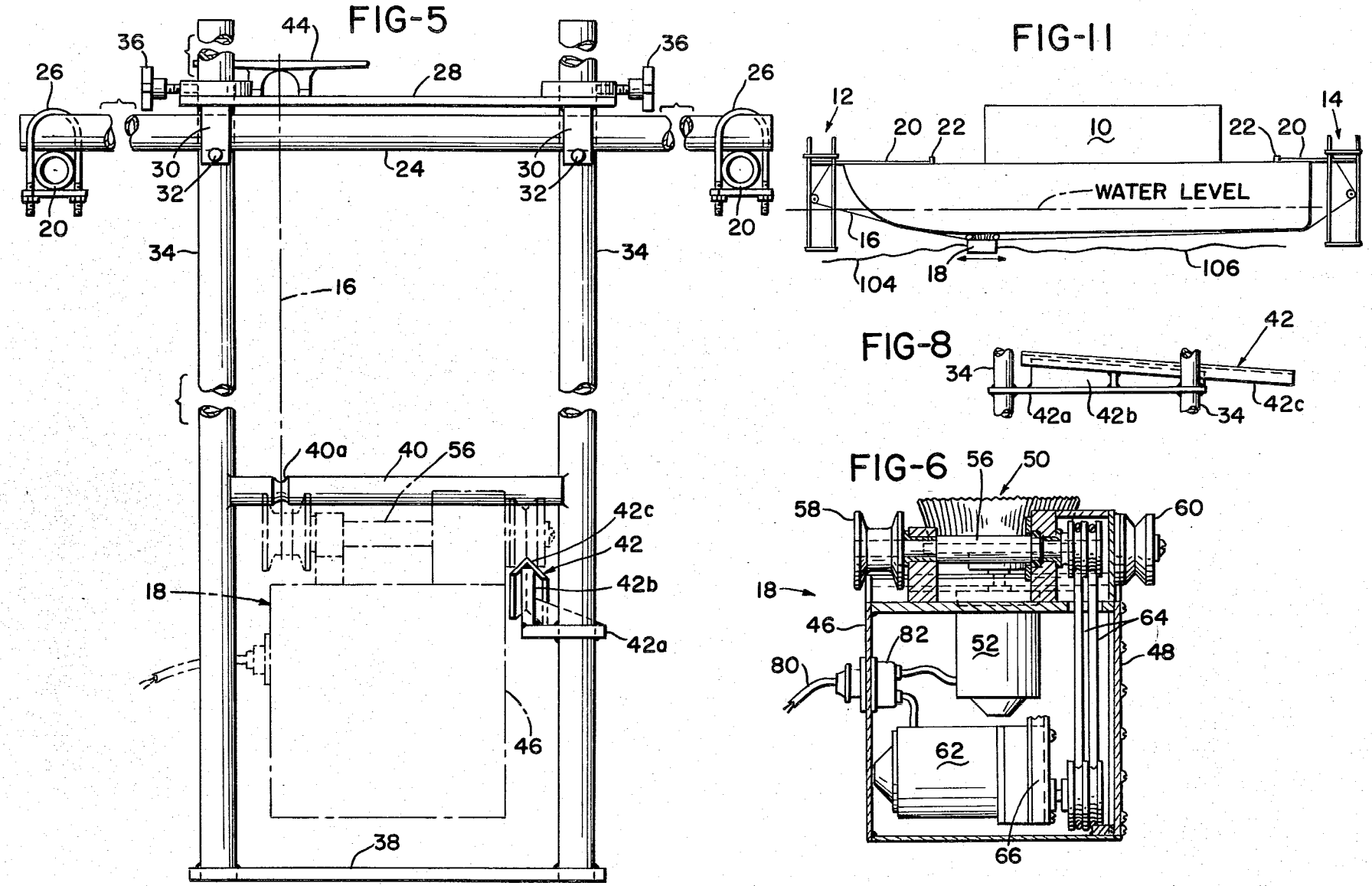
FIG. 5 is an end elevation taken along the line 5—5 of the support structure depicted in FIG. 4, and also depicting the scrubber unit resting on a supporting track attached to the support structure.
FIG. 6 is a cross-sectional view taken along line 6—6 of FIG. 3.
FIG. 8 is a fragmentary side elevation of a typical support track, an end view of which is shown in FIG. 5.

A round rod 40 is welded or otherwise joined to the two outer tubes 34 as most clearly shown in FIGS. 4 and 5. The rod has a turned down portion **40*a* which acts as a guide for the scrubber cable 16. If desired, the vertical position of the rod 40** may be made adjustable in order to better accomodate the scrubber cable.

The forward and rear support structures 12 and 14 are provided with support tracks 42, the primary purpose of which is to support the scrubber unit 18 as it emerges from the water. The relationship between the scrubber unit 18 and the support tracks 42 will be described in more detail below.

The details of the support track 42 are most clearly depicted in the side elevation FIG. 8, and in the end view FIG. 5. The support track 42 has an elongated base plate **42*a*, at one edge of which a vertical plate 42*b* is welded in place. As best shown in FIG. 8 and in FIG. 4, the upper edge of the vertical plate 42*b* is at an angle which slopes downward in the direction of the boat. An inverted angle iron 42*c* is welded to the vertical plate 42*b* as best shown in FIGS. 5 and 8. The angle iron 42*c* thus forms a V-track which will engage the V in idler pulleys on the scrubber unit 18 as depicted in FIG. 5**, and as will be described below.

Figure 3:
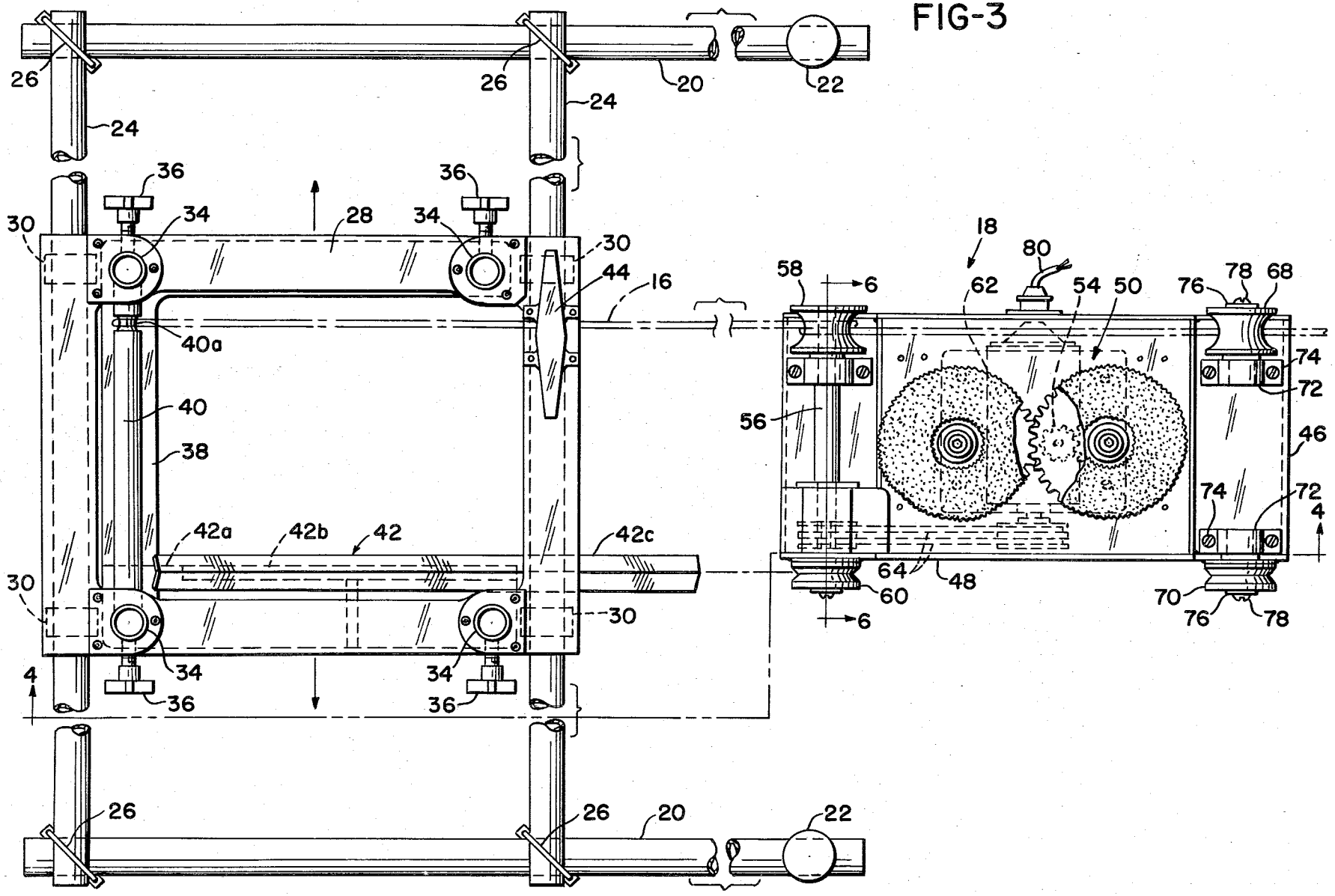
FIG. 3 is an enlarged plan view of the support structure at the bow end of the boat, and the scrubber unit.

Referring specifically to FIGS. 1 and 3, the support track 42 is supported on the near side vertical tubes 34 as depicted on the forward support structure. As best shown in FIG. 8, the vertical tubes 34 pass through apertures in the base plate **42*a*** where they are welded in place.

As stated above, there is a difference between the forward and rear support structures 12 and 14. Reference is specifically made to FIG. 1 in which it will be seen that if the support structure 12 were to be mounted at the stern of the boat, the support track 42 would be on the opposite side of cable 16 from that which is depicted. If support tracks are to be used (not necessary if scrubber unit is not allowed to emerge from the water), then the support tracks must be asymmetrically mounted on the vertical tubes as depicted in FIG. 1.

If support tracks are to be used, and if desired, the tracks may be built in a manner in which the slope of the angle iron **42*c* from the horizontal is variable. Also, the track may be made vertically adjustable on the vertical tubes 34 by omitting the welds and using set screws or other well known means to retain the adjusted position. Adjustable tracks, as described, can be used more easily on boats having various angles of tangency of the scrubber cable 16 with the hull of the boat. Note, for example, the difference depicted in FIG. 2**.

In use, the scrubber cable 16 is installed as illustrated in FIG. 2. The ends of the cable may be held by conventional cleats 44 as shown in FIGS. 2–4; or, by other means. The cable is guided by the turned down portion **40*a* on rod 40 which is included on both support structures, as best seen in FIGS. 2 and 5**.

The third principal component of the present hull scrubber is the scrubber unit 18. This unit may be briefly described as having a closed buoyant chamber housing a rotating power source for rotating external disc scrub brushes, and further being provided with means by which the scrubber unit transports itself to and fro on the scrubber cable 16.

The construction details of the scrubber unit 18 are best illustrated in FIGS. 3, 4, and 6. The scrubber unit 18 has a box-like rectangular housing 46 which is preferably open at the front side as depicted in FIG. 4. The open side of the housing is closed with a cover 48 as best shown in FIG. 6. When the cover is installed by means of a suitable gasket and screws, or by other means known to the art, the combination of housing 46 and cover 48 form a hermetically sealed hollow structure having buoyancy when submerged in water below the hull of the boat.

A disc brush assembly 50 is mounted on the top of housing 46. Although one disc brush will suffice, the preferred arrangement is to have counter revolving brushes as depicted. The thrust of the brushes being in opposite direction will cancel each other and thus prevent the scrubber unit 18 from wanting to swerve from the guide path established by the scrubber cable 16. The brush assembly is driven by a variable speed motor 52, the shaft of which is journaled in the upper plate of housing 46, and which has a drive pinion 54 for driving the brushes as best illustrated in FIG. 3. Disc brushes of the type being used on the scrubber unit are also used on floor polishers and many street cleaners. Their construction and methods of gearing are well known in the art, for which reason they require no further description.

A drive shaft 56 is journaled near one of the upper corners of housing 46 as best shown in FIG. 3. A drive pulley 58 is attached to one end of the shaft for purpose of engaging the scrubber cable 16 as best illustrated in FIG. 3. The other end of shaft 56 supports a V-shaped idler roller 60 for engaging the angle portion of track 42 as the scrubber unit emerges from the water. The drive shaft 56 is driven by a variable speed reversing motor-reduction gear 62 by means of belts 64 running between the outut pulley on the reduction gear and a comparable pulley on the drive shaft 56 as best illustrated in FIGS. 3 and 4. The pulley on shaft 56 which is driven by the belts 64 is contained within an upward extending chamber communicating with housing 46. The motor-reduction gear 62 is mounted and supported by two mounting brackets 66 as best shown in FG. 4. Suitable sealing means, as for example, O-rings, are used on all rotating shafts extending from within the buoyancy chamber formed by the housing 46 and the cover 48. Such seals prevent inward leakage of water from without, and escape of air from within the buoyancy chamber. Various forms of sealing structures are well known to the art, for which reason they require no further description. The mounting brackets 66 add rigidity to the housing 46.

As best illustrated in FIGS. 3 and 4, idler roller 68 and idler roller 70 are mounted to be parallel with the drive shaft 56, and with the idler roller 68 in tracking alignment with pulley 58, and with idler roller 70 in tracking alignment with idler roller 60. The idler rollers may be mounted by any convenient method known to the art. As illustrated in FIG. 3, the idler rollers 68 and 70 are rotatably supported on shafts extending from mounting blocks 72 which may be attached to housing 46 by means of screws 74, or by other means. As illustrated, the rollers are retained in position by use of washers 76 and screws 78. If desired, rollers 60 and 70 may be identical rollers which are held in place in identical manner.

Motor 52 and motor-reduction gear 62 are energized and controlled through power cable 80 in a waterproof connector socket 82, as best shown in FIG. 6. The operator has a control unit (not shown) through which he can start and stop either motor, and reverse the direction of motor 62. Such control units are well known and require no further description.

Specific reference is made to FIG. 7 which illustrates an optional and convenient method for increasing the buoyancy of the scrubber unit 18. The buoyancy of the scrubber unit will vary with its envelope size and the total weight which includes the weight of all components mounted on top and within the unit. Since the type of brushes used will, for the most part, determine the amount of pressure which is desirable, it is advantageous to be able to vary the buoyancy. This is easily accomplished by means of an inflatable rubber-type air cell 84 having an inflation valve 86. The air cell may be removably attached by any of several well known methods, one method being to provide the upper side of the air cell with an integral flange for receiving screws 88 which hold the air cell in place on the bottom side of the scrubber unit. It is desirable to have an air cell which is pleated, because this construction permits the greatest physical expansion at very low pressure, and without stretching the material from which the air cell is made.

The scrubber unit 18 is suspended from the scrubber cable 16 by looping the cable around the drive pulley 58 as depicted in FIG. 3, and then passing it under the idler roller 68. An optional method of suspension is illustrated in FIG. 9, in which the cable 16 is passed under the drive pulley 58 and pressure is applied to increase the friction between the cable and the pulley by means of a tightener 90, a type well known to the art.

The tightener 90 has two rollers **90*a* which rotate on pins 90*b* which are carried by a saddle 90*c* having a stem 90*d* which is free to slide in a guide in which it is restrained from turning by pin 90*e*. The tightener is biased by a compression spring 92 of sufficient strength to apply pressure on the cord 16** and increase the friction between the cord and the pulley to thereby increase the traction of the pulley on the cord.

If a tightener such as tightener 90 is used, it may be mounted in either of two positions. In one position the drive shaft 56 must be extended sufficiently to permit the mounting of the tightener to an appropriate bracket 94 on the side of the housing 46. The idler roller 68 would be extended an equal amount to remain in tracking engagement with the cable. In the second position, the drive pulley 58 and the idler roller 68 would remain as depicted in FIG. 3; however, that portion of housing 46 which is directly below the drive pulley 58 would be altered sufficiently to permit mounting the tightener on the outside of the housing in a position permitting it to act directly on the cable and pulley. When a tightener is used, the cable would engage the drive pulley in the manner depicted in FIG. 9, and not as depicted in FIG. 3.

Cable 16 may take the form of any elongated flexible member. Within the scope of the present invention, the elongated flexible member may be a rope, a line, a cable, or a chain of the type used for bicycle chains, for example.

If a chain is used as cable 16, then the drive pulley 58 and the idler roller 68 as depicted in all the drawings with the exception of FIG. 10 would be replaced with sprockets as depicted in FIG. 10. All the other elements of the combination would remain the same as depicted.

Referring specifically to FIG. 10, a chain **16*a* is shown in operable relationship with scrubber unit 18. The drive pulley 58 is replaced by drive sprocket 96, and idler roller 68 is replaced by idler sprocket 98. An adjusting idler sprocket 100 is mounted on a flat bracket 102. The use of an adjusting idler sprocket, such as sprocket 100** is well known as a method for holding a chain in engagement with a drive sprocket, for which reason it requires no further description.

To prepare for scrubbing, the forward support structure 12 and the rear support structure 14 are adjusted to position on the boat. As best illustrated in FIG. 2, the structures are vertically positioned to place the bottom base plate of the support track 42 on the waterline. This horizontal plate acts as a gauge for positioning the track at the proper elevation. If support tracks are not used, the waterline position may be marked by other means, once it has been established.

It should also be noted in FIG. 2 that the vertical location of the rod 40 in relationship with the waterline will determine the angle of departure of cable 16 as it leaves the water. If the support tracks are made to be adjustable, they should be adjusted to have the angle iron guide track substantially parallel with the cable.

Because a boat is rarely in placid water and there is usually some pitching and rolling, it may be desirable to add guides to the track assembly which will guide the rollers 60 and 70 of the scrubber unit onto the track. Such guides are common, and are used on many types of equipment. Guides are well known to the art, for which reason they require no further description.

The most advantageous position for mounting the two support structures on a boat will be established during first use. Time and effort during subsequent uses will be saved if at this time the U-clamps 26 are replaced with bolts and nuts. Before disassembly for storage, holes should be drilled through the tubes 20 and 24 at their juncture. The tubes may then be easily adjusted to their correct position by the bolts. The position of the tubes 20 at the locating points on the boat should also be indicated, as this establishes the extending position of the support structures from the bow and stern of the boat.

One method of attaching the scrubber unit 18 to the scrubber cable 16 is best illustrated in FIG, 3. The cable would be looped around the pulley 58 and under idler roller 68 as indicated. This will prevent separation of the scrubber unit from the cable.

Since the scrubber unit is attached to the cable on one side only, there is a natural tendency for the scrubber unit to pivot about the cable. When the scrubber unit is submerged in the water, the buoyancy of the scrubber unit applies an upward thrust about the pivot axis and holds the brushes of the scrubber unit firmly against the hull of the boat. The force of the thrust is established by the amount of the buoyancy.

As the scrubber unit emerges from the water, the buoyancy is reduced, and the scrubber unit will want to pivot downward about the cable pivot. When out of the water, the scrubber unit would dangle from the cable unless restrained from doing so. The principal purpose of the track is to support the scrubber unit when it is not fully submerged, and thereby maintain it in correct normal position.

The scrubbing may commence from any transverse position on the hull. The cable 16 should be maintained on a longitudinal axis which is parallel with the longitudinal axis of the boat. One easy method is, during first use, to properly align the cable and then mark this indexing position on one of the tubes 24 on both the front and rear support structures where it will be in alignment with an edge of the carriage 28. By using several alternating colors of paint, bands may then be painted on the marked tubes 24; the bands being of the width the cable is to be shifted on the hull of the boat. The amount of the desired shift will be largely governed by the diameter of the brushes, and by the desired overlap in successive positions of the scrubbing path on the hull.

There is no correlation between the rotary speed of the scrub brushes and the linear speed at which the scrubber unit moves on the cable because the operator can vary the speed of the motor-reduction gear 62. This feature permits adjustment which is based on the type of scrub brushes being used, and on the composition of the adhering debris on the hull.

Within the scope of the invention, one scrub brush may be used; however, it will be found that two counter rotating brushes are preferred.

FIG. 11 depicts a simplified species of the invention which is less expensive; for which reason it may be preferred by some boat owners. The major simplification is to omit the motor-reduction gear 62, and to manually move the scrubber unit on the cable 16. A further simplification, if the scrubber unit is not permitted to emerge from the water, is to delete the support tracks 42. The scrubber unit may be moved to and fro by the lines 104 and 106 controlled by an operator at each end of the boat. If desired, a suitable pulley arrangement may be used which will permit one operator to move the scrubber unit from a single position in the same manner draperies are moved across a window from a single position.

It is to be understood that the embodiments of the present invention as shown and described are to be regarded merely as illustrative, and that the invention is susceptible to variations, modifications and changes, without regard to specific construction methods, within the scope of the appended claims.

I claim:

1. A portable boat hull scrubber for detachably mounting onto a floating boat, said scrubber comprising:

(a) forward and rear support structures adapted for attaching to the bow and stern of said boat and longitudinally extending therefrom, each of said support structures having a carriage laterally slidable to the longitudinal axis of said boat, at least one of said support structures further having at least one vertical element extending downward from said carriage and carrying a support track assembly having a guide track substantially parallel to the longitudinal axis of said boat and sloping downward from the horizontal toward said boat, and with the low end of said guide track proximate to the surface of the water floating said boat;

(b) an elongated flexible member for passing longitudinally below the hull of said boat, and with one end attached to the carriage of said forward support structure and the opposing end attached to the carriage of said rear support structure;

(c) a scrubber unit adapted for detachably suspending from said elongated flexible member and comprising:

(c-1) a hollow hermetically sealed buoyancy chamber having a substantially flat upper side;

(c-2) at least one disc scrubbing brush having upward extending bristles and being mounted on the upper side of said buoyancy chamber to be rotatable about a vertical axis;

(c-3) a controllable power source within said buoyancy chamber for rotating said disc scrubbing brush;

(c-4) a plurality of circular elements rotatable on parallel axes and mounted on a longitudinal side of said buoyancy chamber for detachably suspending said scrubber unit on said elongated flexible member;

(c-5) a plurality of idler rollers mounted on the longitudinal side of said buoyancy chamber opposite from the side mounting said circular elements and with the axes of rotation of said idler rollers parallel with the axes of rotation of said circular elements; and, (d) means for moving said scrubber unit to and fro longitudinally on said elongated flexible member to thereby scrub a path on the hull of said boat, said idler rollers engaging said guide track as said scrubber unit emerges from the water to prevent said scrubber unit from dangling on said elongated flexible member.

2. A portable boat hull scrubber in accordance with claim 1 in which the buoyancy chamber on said scrubber unit has an inflatable rubber-type air cell on the bottom thereof.

3. A portable boat hull scrubber in accordance with claim 1 in which the means for moving said scrubber unit on said elongated flexible member is a reversible motor-reduction gear within said buoyancy chamber for rotating at least one of said circular elements thereon.

4. A portable boat hull scrubber for detachably mounting onto a floating boat, said scrubber comprising:

(a) forward and rear support structures adapted for attaching to the bow and stern of said boat and longitudinally extending therefrom, each of said support structures having a carriage laterally slidable to the longitudinal axis of said boat, and further having at least one vertical element extending downward from said carriage and carrying a support track assembly having a guide track substantially parallel to the longitudinal axis of said boat and sloping downward from the horizontal toward said boat, with the low end of said guide track proximate to the water floating said boat;

(b) an elongated flexible member for passing longitudinally below the hull of said boat, and with one end attached to the carriage of said forward support structure and the opposing end attached to the carriage of said rear support structure;

(c) a scrubber unit adapted for detachably suspending from said elongated flexible member and comprising:

(c-1) a hollow hermetically sealed buoyancy chamber having a substantially flat upper side;

(c-2) at least one disc scrubbing brush having upward extending bristles and being mounted on the upper side of said buoyancy chamber to be rotatable about a vertical axis;

(c-3) a controllable power source within said buoyancy chamber for rotating said disc scrubbing brush;

(c-4) a plurality of circular elements rotatable on parallel axes and mounted on a longitudinal side of said buoyancy chamber for detachably suspending said scrubber unit on said elongated flexible member;

(c-5) a plurality of idler rollers mounted on the longitudinal side of said buoyancy chamber opposite from the side mounting said circular elements and with the axes of rotation of said idler rollers parallel with the axes of rotation of said circular elements; and, (d) means for moving said scrubber unit to and fro longitudinally on said elongated flexible member to thereby scrub a path on the hull of said boat, said idler rollers engaging said guide track on said forward and rear support structures as said scrubber unit emerges from the water at the bow and stern of said boat to prevent said scrubber unit from dangling on said elongated flexible member.

5. A portable boat hull scrubber in accordance with claim 4 in which the buoyancy chamber on said scrubber unit has an inflatable rubber-type air cell on the bottom thereof.

6. A portable boat hull scrubber in accordance with claim 4 in which the means for moving said scrubber unit on said elongated flexible member is a reversible motor-reduction gear within said buoyancy chamber for rotating at least one of said circular elements thereon.

* * * * *